United States Patent [19]

Amsler

[11] 4,004,117

[45] Jan. 18, 1977

[54] ARCING ELECTRODE, MORE PARTICULARLY FOR VACUUM SWITCHES

[75] Inventor: Joachim Amsler, Seon, Switzerland

[73] Assignee: Sprecher & Schuh AG, Aarau, Switzerland

[22] Filed: Sept. 18, 1974

[21] Appl. No.: 507,253

[52] U.S. Cl. ..... 200/144 B

[51] Int. Cl.[2] ..... H01H 33/66

[58] Field of Search ..... 200/144 B

[56] References Cited

UNITED STATES PATENTS

| | | | |
|---|---|---|---|
| 3,773,993 | 11/1973 | Amsler | 200/144 B |

FOREIGN PATENTS OR APPLICATIONS

| | | | |
|---|---|---|---|
| 1,389,836 | 1/1965 | France | 200/144 B |
| 1,511,782 | 12/1967 | France | 200/144 B |
| 16,218 | 5/1971 | Japan | 200/144 B |
| 351,324 | 2/1961 | Switzerland | 200/144 B |
| 993,987 | 6/1965 | United Kingdom | 200/144 B |

*Primary Examiner*—Robert S. Macon

[57] ABSTRACT

An arcing electrode in accordance with the invention has a number of plates separated by gaps. The plates are shaped with if necessary, additional plates into a receptacle for metal droplets produced by the arc.

3 Claims, 10 Drawing Figures

Figure 1:
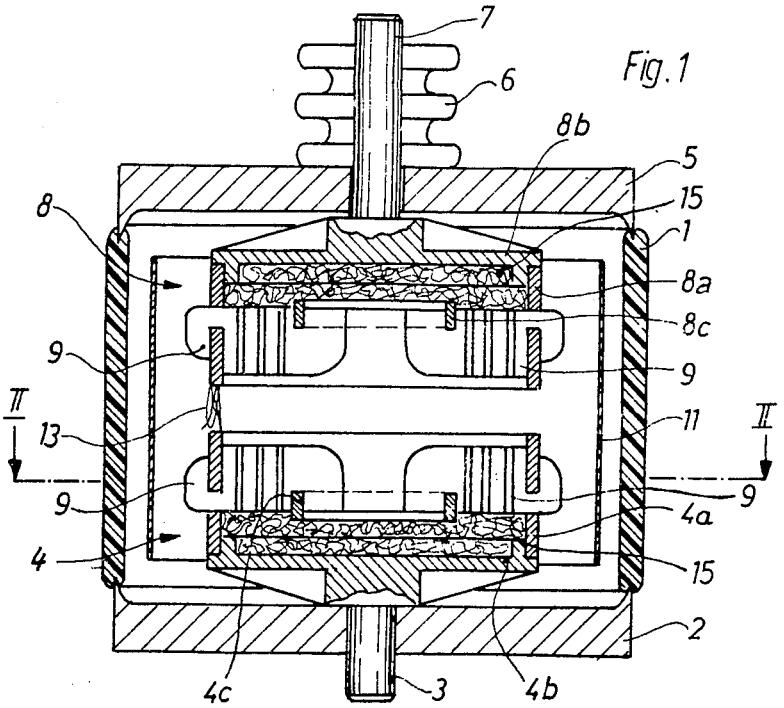

Fig. 5
PRIOR ART
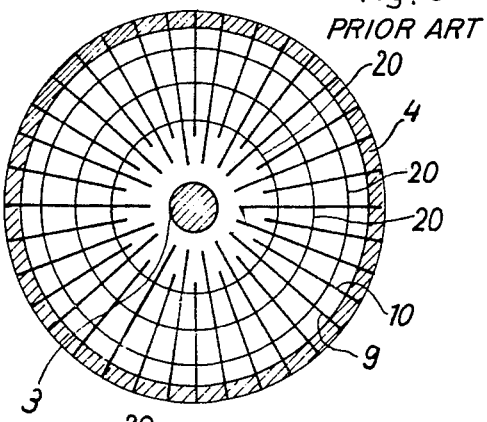
Fig. 6
PRIOR ART
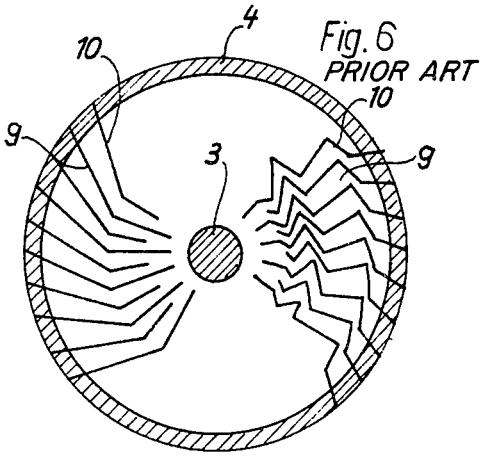
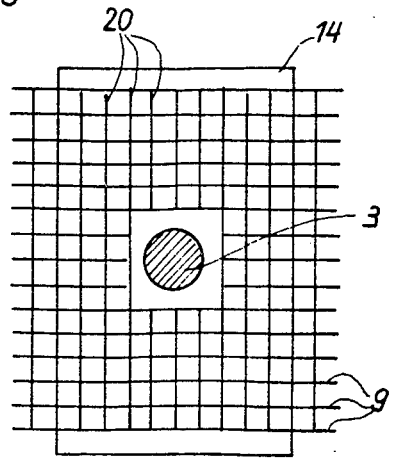
Fig 7
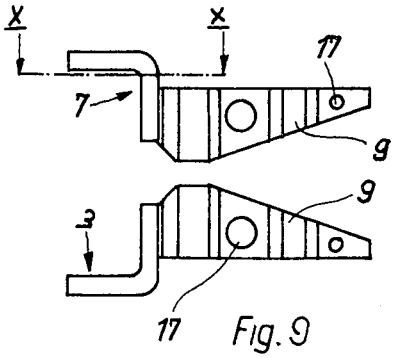
Fig. 9
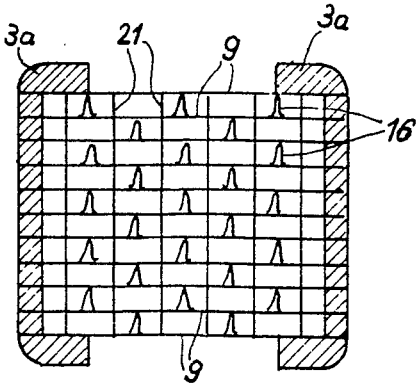
Fig. 8
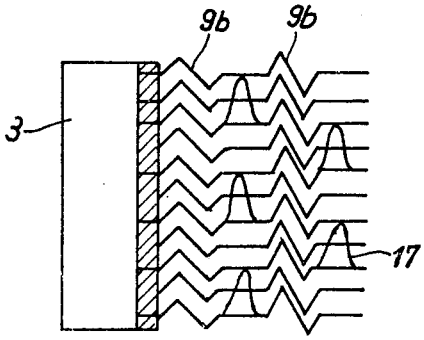
Fig. 10

ARCING ELECTRODE, MORE PARTICULARLY FOR VACUUM SWITCHES

The copending patent application Ser. No. 363,048 dated May 23, 1973, now U.S. Pat. No. 3,866,005, hereinafter referred to as the parent application, relates to an arcing electrode, more particularly for a contact assembly in a vacuum switch for taking up arc roots, the electrode comprising a number of plates, the narrow surfaces of the plates being at the endface of the electrode, characterized in that gaps are left between the individual plates, the width of the gaps being at least equal to the thickness of a plate.

In a switch equipped with arcing electrodes of the aforementioned kind, the arc burns diffusely even if the currents switched off are between approximately 5 and 10 KA, so that the contact burning is much less than in a switch in which a column arc forms between the electrodes at the aforementioned high currents. The switches described in the parent patent are provided, in addition to the arcing electrodes, with auxiliary contacts through which the current flows. When the auxiliary contacts open, the resulting arc switches to the arcing electrodes, where it is quenched. In order to ensure that the arc switches from the auxiliary contacts to the arcing electrodes, the auxiliary contacts must be separated by a relatively large gap, which requires a drive mechanism having a correspondingly strong stroke. In order to obviate the need for an expensive drive, the arcing electrode plates are rigidly connected by conductive contact studs as described in the parent patent. When a vacuum switch provided with the improved arcing electrodes is opened, an arc first appears between the contact surfaces of the studs and is switched by the intrinsic magnetic field from the contact surfaces to the narrow surfaces of the plates, where it burns diffusely until it is quenched.

Vacuum switches containing arcing electrodes according to the parent patent are usually reliable during their long service life. It has been found, however, that faults may sometimes occur, and that these faults are due to small needle-like metal particles which form after the switch begins operation and migrate or fall into the gap. It has been found that these needle-like particles originate in the arcing-electrode plates, which are usually iron. When the contacts separate, the arc ignites between the studs and drops of molten metal from the arc root are thrown off the studs. The drops strike and bespatter the iron plates without sticking to them. After solidifying, the metal forms needle-like particles which drop off and may interfere with the operation of the switch.

An object of the invention is to prevent the afroementioned needle-like metal particles from forming in an arcing electrode according to the parent patent.

To this end, according to the invention, individual plates are shaped and/or other plates are added to the arcing-electrode plate assembly to form a receptacle for all the metal droplets ejected from the arc root, each metal droplet striking the receptacle at an angle between 30° and 90°. The plate asembly is devised in the aforementioned manner so that the incident metal particles adhere to the metal and solidify there without coming loose. The plates in the assembly which extend in the direction of motion of the ejected particles can be bent into a zig-zag, at least in the neighborhood of the arc roots, the side of each serration facing the arc roots having a gradient corresponding to the aforementioned angle of incidence, in relation to the path of the droplets. The height of the serrations can be greater than the gap between individual plates, so that the serrations in adjacent plates fit into one another without contact and do not leave any free paths for the metal droplets to travel through the plate assembly. Assemblies comprising flat plates or zig-zag bent plates, wherein the height of the serrations is less than the gap between individual plates, can be given a honeycomb structure by means of additional plates, which are preferably pushed from beneath like a comb against the first-mentioned plates, the additional plates blocking any path along which drops could travel through the plate assembly.

Figure 2:
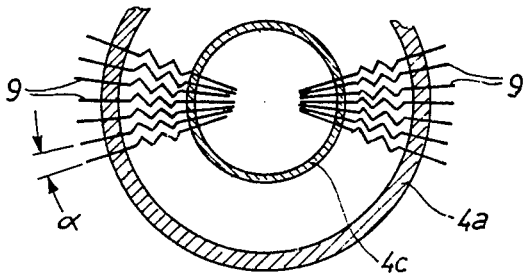
Figure 3:
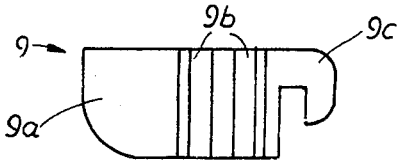
Figure 4:
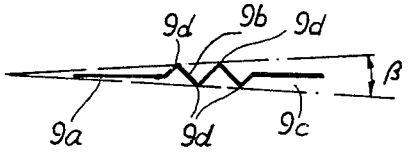

Embodiments of the invention will now be described with reference to the drawings, in which:

FIG. 1 is an axial section through a vacuum switch comprising arcing electrodes comprising radial plates, wherein the plates are bent into a zig-zag near the arc root, FIG. 2 is a cross-section through an arcing electrode in the vacuum switch according to FIG. 1, FIG. 3 is a side view of an arcing-electrode plate, FIG. 4 is a plan view of the plate in FIG. 3, FIG. 5 is a plan view of a honeycomb-structure arcing electrode having a central auxiliary contact, FIG. 6 is a plan view of an arcing electrode having bent plates according to the parent patent, the plates being bent into a zig-zag, FIG. 7 is a plan view of another electrode according to the parent patent, comprising parallel plates and additional plates providing a honeycomb structure, FIG. 8 is a plan view of an arcing electrode, comprising parallel plates according to the parent patent and having additional plates for forming a honeycomb structure, FIG. 9 is a side view of an arcing electrode having contact studs forming a loop and zig-zag bent plates, and FIG. 10 is a plan view of the arcing electrode in FIG. 9.

The vacuum switch shown in axial section in FIG. 1 and in cross-section in FIG. 2 has a vacuum-tight housing comprising a cylindrical part 1 made of electrically insulating material and two metal covers 2 and 5. The bottom metal cover 2 bears the stationary arcing electrode, which is secured therein by contact stud 3. A moving contact 7 is disposed in the top metal cover 5 and is secured by a metal bellows 6 to cover 5 and bears the other arcing electrode. The two arcing electrodes are identical. Each electrode has a pot-shaped support 4, 8 respectively, comprising a cylindrical part 4*a* or 8*a* and a bottom 4*b* or 8*b*. The facing endfaces of the two cylindrical parts 4*a* and 8*a* are the contact surfaces of the switch, between which an arc 13 burns when the switch opens. Radial plates 9 are disposed in the tubular cylindrical part 4*a* or 8*a* and project into the electrode, their inner ends being connected by a retaining ring 4*c* or 8*c*, in order to obtain a mechanically stable plate assembly. Plates 9 are preferably made of iron and supports 4 and 8 and contact studs 3 and 7 are preferably made of copper. Each arcing electrode 4, 8 contains a metal sponge in the cavity underneath plate 9, the sponge acting as a condenser 15 for condensing the metal vapor given off by the burning arc, as described in detail in copending U.S. Ser. No. 502,396. The inner surface of the cylindrical part 1 is protected by a tubular metal plate 11 against condensing metal vapor from the burning arc.

As FIG. 2 shows, the radial plates 9 are uniformly distributed around the periphery of the cylindrical electrode support 4*a* or 8*a*, so that there is a gap having an aperture angle Δ between each pair of adjacent plates. In this embodiment, as shown in FIGS. 3 and 4, plates 9 are identical and have an outer flat portion 9*a*, a zig-zag bent central portion 9*b* and a flat portion 9*c*. The outer flat portions 9*a* of plates 9 are held in the cylindrical supports 4*a* or 9*a* and the inner flat portions 9*c* are interconnected by a retaining ring 4*c* or 8*c*, so that the zig-zag bent central portions of plates 9 lie between the cylindrical electrode support and the retaining ring. The plane of each plate 9 is the central plne for the serrations formed therein (FIG. 4) and on each side of the plate, the top edges 9*d* of the zig-zags lie in radial planes, having an angle of aperture $\beta$ greater than the angle $\alpha$ between the plates. Accordingly, in the plate assembly shown in FIG. 2, serrations in adjacent plates 9 engage inside one another without touching and block any straight path through the gap between the plates. The sides of the serrations are at an angle of more than 30° to the central plane (in the example shown they are at an angle of 45°).

When the arcing electrodes separate, arc 13 is ignited and droplets of molten metal are hurled outwards and inwards from the arc roots. The drops thrown outwards fall practically vertically on to plate 11 and adhere thereto. The droplets thrown inwards into the gap between plates 9 strike the sides of the serrations, which are at a steep angle to their path, and adhere thereto.

FIG. 5 is a plan view of an arcing electrode according to the parent patent, wherein radial plates 9, 10 are provided in a tubular electrode support 4. Support 4 concentrically surrounds a contact stud 3 of an auxiliary contact having an endface of which an arc root is situated when the switch is opened and an arc ignites. Plates 9, 10 are flat. Additional circular bent plates 20 are provided, which are disposed concentrically with respect to stud 3 and are inserted in slots in the flat plates 9, 10 so that the plate assembly has a honeycomb structure which captures all the ejected metal droplets, which adhere to the honeycomb walls. At heavy currents, the plates may melt locally in addition to metal being ejected from the studs; accordingly the plate assembly is given a fairly "dense" honeycomb or zig-zag structure. Structures of this kind are possible for all embodiments of arcing electrodes according to the parent patent and the patent of addition.

The left half of FIG. 6 is a plan view of an arcing electrode according to the parent patent, wherein the plates 9, 10 inserted into the tubular supports 4 are bent, resulting in a tangential acceleration of the arc burning between the electrodes. This bend in the plates, however, is not sufficient for reliably preventing the production of needle-like metal particles. A correspondingly improved embodiment of the arcing electrode is shown in the right half of FIG. 6. Both portions of each plate 9, 10 are bent into a zig-zag, thus providing a dense plate assembly.

FIG. 7 is a plan view of an improved version of another arcing electrode described in the parent patent. The flat parallel plates 9 are inserted into slots in support 14. A contact stud 3 is disposed in the middle of support 14. Additional plates 21 extending perpendicular to plates 9 provide the arcing electrode with a honeycomb structure having a plurality of cells. As is usual in such construction, plates 9, 21 have slots and fit into one another.

FIG. 8 is a plan view of an arcing electrode based on an embodiment described in the parent patent, wherein the contact studs 3*a* are two U-sectional members on edge. Parallel flat plates 9 are disposed between the sectional members. Plates 9 have indentations opposite adjacent plates so as to maintain a space between plates 9 in spite of the forces resulting from the parallel current paths. Although these indentations 16 capture some ejected metal droplets, they are not capable of completely preventing needle-like particles from forming. Accordingly, the arcing electrode has additional plates 21 which co-operate with plates 9 to provide the desired honeycomb structure.

Another embodiment of arcing electrodes according to the aforementioned parent patent is shown in FIGS. 9 and 10, i.e. in side view in FIG. 9 and in plan view in FIG. 10. The contact studs 3 and 7 form a loop for the current. Lateral projecting plates 9 are secured to studs 3, 7 and, after the switch opens, an arc burns between studs 3 and 7. The plates 9 of one stud 3 are offset with respect to the plates 9 of the other stud 7, so that when the studs are closed, the plates mesh like a comb near the contact surfaces. The plates 9 of each contact stud 3, 7 have indentations 17 for bracing one another in the assembly. If plates 9 were flat, indentations 17 would as before be incapable of capturing and trapping all the metal droplets. Accordingly, as shown more particularly in FIG. 10, the plates are bent into a zig-zag. The plates in each contact stud have serrations 9*b*, more particularly near the stud, the total height of the serration being greater than the gap between parallel plates, so that the set of plates forming each contact stud blocks every straight path through the gap.

Zig-zag bent plates appear to be cheaper to manufacture than additional plates, since the latter also have to be secured to the electrode plates. Copending U.S. Ser. No. 502,396, describes electrodes containing sheet-metal baffles under the plates, so as to condense the resulting metal vapor. In arcing electrodes of the last-mentioned kind, the plate assembly can preferably have a honeycomb structure, since the baffles can be shaped and disposed so that they can also be used to form the honeycomb structure in the plate assembly.

I claim:

1. A contact assembly for a vacuum switch comprising two electrodes facing each other for taking up arc roots, each of said electrodes including a contact stud having a contact surface and a plurality of plates having narrow surfaces facing the opposite electrode, the plates being separated by gaps whose width is equal to at least the thickness of the plate, and further electrode plates intersecting the first said electrode plates at an angle to form a honeycomb structure at least in proximity to the contact surfaces of the nearest contact stud.

2. A contact assembly according to claim 1 wherein the first said electrode plates are radially oriented and the said further electrode plates are curved in a circle and are disposed concentrically in the plate assembly.

3. A contact assembly according to claim 1 wherein the first said electrode plates are disposed parallel to each other and the said further electrode plates are planar and disposed perpendicularly to the first electrode plates in the plate assembly.

* * * * *